US006935041B2

(12) United States Patent
Orton

(10) Patent No.: US 6,935,041 B2
(45) Date of Patent: Aug. 30, 2005

(54) MODULAR FRAMING TOOL

(76) Inventor: Mark B. Orton, 04 Lost Spring Rd., Mimbres, NM (US) 88049

( * ) Notice: Subject to any disclaimer, the term of this patent is extended or adjusted under 35 U.S.C. 154(b) by 0 days.

(21) Appl. No.: 10/422,416

(22) Filed: Apr. 23, 2003

(65) Prior Publication Data

US 2003/0200667 A1 Oct. 30, 2003

Related U.S. Application Data

(60) Provisional application No. 60/397,561, filed on Jul. 22, 2002, and provisional application No. 60/375,274, filed on Apr. 24, 2002.

(51) Int. Cl.[7] ..... G01D 21/00
(52) U.S. Cl. ..... 33/613
(58) Field of Search ..... 33/613, 645, 562, 33/418, 429, 456, 474, 478, 451

(56) References Cited

U.S. PATENT DOCUMENTS

| | | | | | |
|---|---|---|---|---|---|
| 735,136 | A | * | 8/1903 | Nelson | 33/478 |
| 1,350,633 | A | | 8/1920 | Allsworth | |
| 2,105,771 | A | | 1/1938 | Holdsworth | 72/46 |
| 2,466,919 | A | * | 4/1949 | Sykes | 33/526 |
| 2,567,586 | A | * | 9/1951 | Werder | 33/562 |
| 2,686,959 | A | * | 8/1954 | Robinson | 33/613 |
| 3,169,320 | A | * | 2/1965 | Currie | 33/429 |
| 3,827,201 | A | | 8/1974 | Struben | 52/169 |
| 4,212,108 | A | * | 7/1980 | Jackson | 33/501 |
| 4,327,501 | A | * | 5/1982 | Hurt | 33/465 |
| 4,586,305 | A | | 5/1986 | Balinski | 52/241 |
| 4,651,484 | A | | 3/1987 | Rutkowski | 52/241 |
| 4,672,785 | A | | 6/1987 | Salvo | 52/241 |
| 4,688,358 | A | | 8/1987 | Madray | 52/90 |
| 4,712,309 | A | * | 12/1987 | Kingston et al. | 33/527 |
| 4,854,096 | A | | 8/1989 | Smolik | 52/241 |
| 5,048,243 | A | | 9/1991 | Ward | 52/167 |
| 5,216,859 | A | | 6/1993 | Moreno et al. | 52/238.1 |
| 5,274,973 | A | | 1/1994 | Liang | 52/243 |
| 5,367,783 | A | * | 11/1994 | Nygren | 33/613 |
| 5,660,012 | A | | 8/1997 | Knudson | 52/241 |
| 5,822,942 | A | | 10/1998 | Lucia, Jr. | 52/514 |
| 6,088,982 | A | | 7/2000 | Heisberger | 52/241 |
| 6,334,261 | B1 | * | 1/2002 | Scillia et al. | 33/456 |
| 6,442,853 | B1 | * | 9/2002 | Hale et al. | 33/194 |
| 6,463,666 | B1 | * | 10/2002 | Szumer | 33/484 |

* cited by examiner

*Primary Examiner*—Christopher W. Fulton
(74) *Attorney, Agent, or Firm*—Kunzler & Associates

(57) ABSTRACT

Disclosed is a modular framing tool and a method for beam framing. The modular framing tool of the present invention comprises alignment members attached to a common body portion. In one embodiment, the tabs are permanently and rotatably attached with a locking mechanism. Alternatively, the alignment members are removable and selectively positionable. Additionally, the modular framing tool comprises a tool attachment that may be configured to join the body portion to form a T-Square, a framing square, or the like. A leveling apparatus may also be attached to form a large leveling tool. The method comprises attaching or extending the alignment members, receiving the first beam, outlining the alignment members on the first beam, and after removing the tool, attaching a plurality of beams at the locations outlined by the alignment members. The alignment members maybe configured with a width equivalent to the thickness of the beam member to be attached.

20 Claims, 8 Drawing Sheets

MODULAR FRAMING TOOL

RELATED APPLICATIONS

This application claims priority to U.S. provisional patent application Ser. No. 60/375,274 Filed on Apr. 24, 2002 for Mark B. Orton and to U.S. Provisional patent application Ser. No. 60/397,561 Filed on Jul. 22, 2002 for Mark B. Orton.

BACKGROUND OF THE INVENTION

1. The Field of the Invention

The invention relates to framing tools and more specifically, to multi-use framing systems and their methods of use.

2. The Relevant Art

Traditionally many buildings, especially homes, across the United States have largely been built using timber frame construction methods. In framing such buildings, a concrete foundation is first formed, and then the exterior and interior walls are built. Generally, anchor bolts are embedded in the concrete at intervals specified by the local building code. Then, using a tape measure, holes are marked, and then drilled in a base plate that will be fitted over the anchor bolts in a process commonly referred to as "center transferring," or "transferring centers." Once anchored, the builder can then begin to frame the walls of the house. The base plate is marked, usually at 16 or 24 inch intervals, and studs are attached at the markings in a perpendicular position with respect to the base plate. Sometimes, a wall may be framed in its entirety before being lifted into position and secured with anchor bolts. Each of these processes, however, requires a broad array of different tools.

Once the walls are framed, the builder then begins the roofing process. A common residential construction method for assembling a roof will be described herein. Under the process, individual truss units are shipped to the construction site. At the construction site, walls are formed, and generally include an upper beam that supports the trusses. The truss units are placed upon opposing supporting beams to span the distance between walls. A plurality of truss units is placed in a row with a selected spacing between trusses. The spacing is most commonly approximately 24 inches. The trusses are required to be accurately spaced from each other to provide uniform strength.

Many alignment tools are commonly available and come in many forms, including flexible tapes, and rigid poles. For example, an alignment and spacing tool of the prior art comprises a plurality of tool segments, each designed to extend between a pair of adjacent truss units. Each tool segment is configured to engage a surface of the truss unit. Rivets are provided to connect each tool unit. The rivets permit adjacent tool members to pivot about each other, allowing the segments to fold up much like a foldable measuring stick. Disengaging such a tool such for reuse is possible, but at times difficult. Other such systems tend to be expensive and not easily compacted or easily transported.

Additionally, the framing process requires that a builder carry many tools. For example, the builder needs an accurate way to mark stud location. The builder also needs a tool to transfer centers, a tool such as a framing square to make square walls, and a level.

Accordingly, it should be apparent that a need exists for an improved, inexpensive, modular system of tools that solves the many needs facing builders. A framing tool that embodies the aforementioned functions and is easily transportable, adaptable to variously dimensioned stud systems, and simple to use is desirable.

OBJECTS AND BRIEF SUMMARY OF THE INVENTION

The modular framing tool of the present invention has been developed in response to the present state of the art, and in particular, in response to the problems and needs in the art that have not yet been fully solved by currently available framing tools. Accordingly, it is an overall object of the present invention to provide a modular framing tool that overcomes many or all of the above-discussed shortcomings in the art.

To achieve the foregoing object, and in accordance with the invention as embodied and broadly described herein in the preferred embodiments, an improved modular framing tool is provided. Preferably, the modular framing tool comprises a body portion, a plurality of alignment members attached to the body portion, and a tool attachment.

In one embodiment, the plurality of alignment members is configured to be removable and selectively positionable in a manner useful for positioning beams and/or framing a house. Alternatively, the plurality of alignment members may be configured to be permanently attached to the modular framing tool and dynamically positionable in a manner useful for positioning beams and/or framing a house.

In one embodiment, the alignment members are rotatably attached and configured to protrude from the body portion at a substantially perpendicular angle. The alignment members may also comprise a hole disposed therein for ease of retraction. Alternatively, the hole is configured for temporary attachment to a beam. In one embodiment, the alignment members further comprise a spring loaded locking apparatus configured to maintain the alignment member in an extended position.

The alignment members are preferably positionable at intervals of either 16 or 24 inches, the traditional intervals of stud and truss systems respectively. In one embodiment, the modular framing tool comprises a clip attachment adapted to connect a first body portion to a second body portion to form an additional regularly spaced channel therein.

In one embodiment, the tool attachment comprises a squaring attachment that may comprise a cut-out portion disposed at one end of the elongated substantially rectangular member, the cut-out portion configured to receive therein an anchor bolt for transferring centers. Additionally, the squaring attachment may further comprise a plurality of holes disposed proximal to the cut-out portion, the holes adapted to transfer centers. Preferably, the plurality of holes of the squaring attachment are selectively positioned to form a T-square, or alternatively, a framing square when the squaring attachment is connected to the body portion. The modular framing tool of may also comprise a leveling apparatus for accurate leveling of the beam.

A method is also provided under the present invention for using a modular framing tool to position a beam. The method comprises providing a modular framing tool having a plurality of alignment members, dynamically positioning the alignment members, receiving a first beam, outlining the alignment members on the first beam, removing the modular framing tool from the first beam, and securing a second beam perpendicularly to the first beam at the location outlined by the alignment members.

In one embodiment, positioning the alignment members comprises temporarily attaching the alignment members to the body portion at desired intervals. Alternatively, positioning the alignment members comprises rotating the permanently attached alignment members to a protracted and substantially perpendicular position. The method may also comprise locking the alignment members in the protracted and substantially perpendicular position. Additionally, the method may comprise aligning a truss system that comprises at least a first and a second truss unit, or alternatively, aligning a stud system comprising at least a first and a second stud unit.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENT

Figure 1:
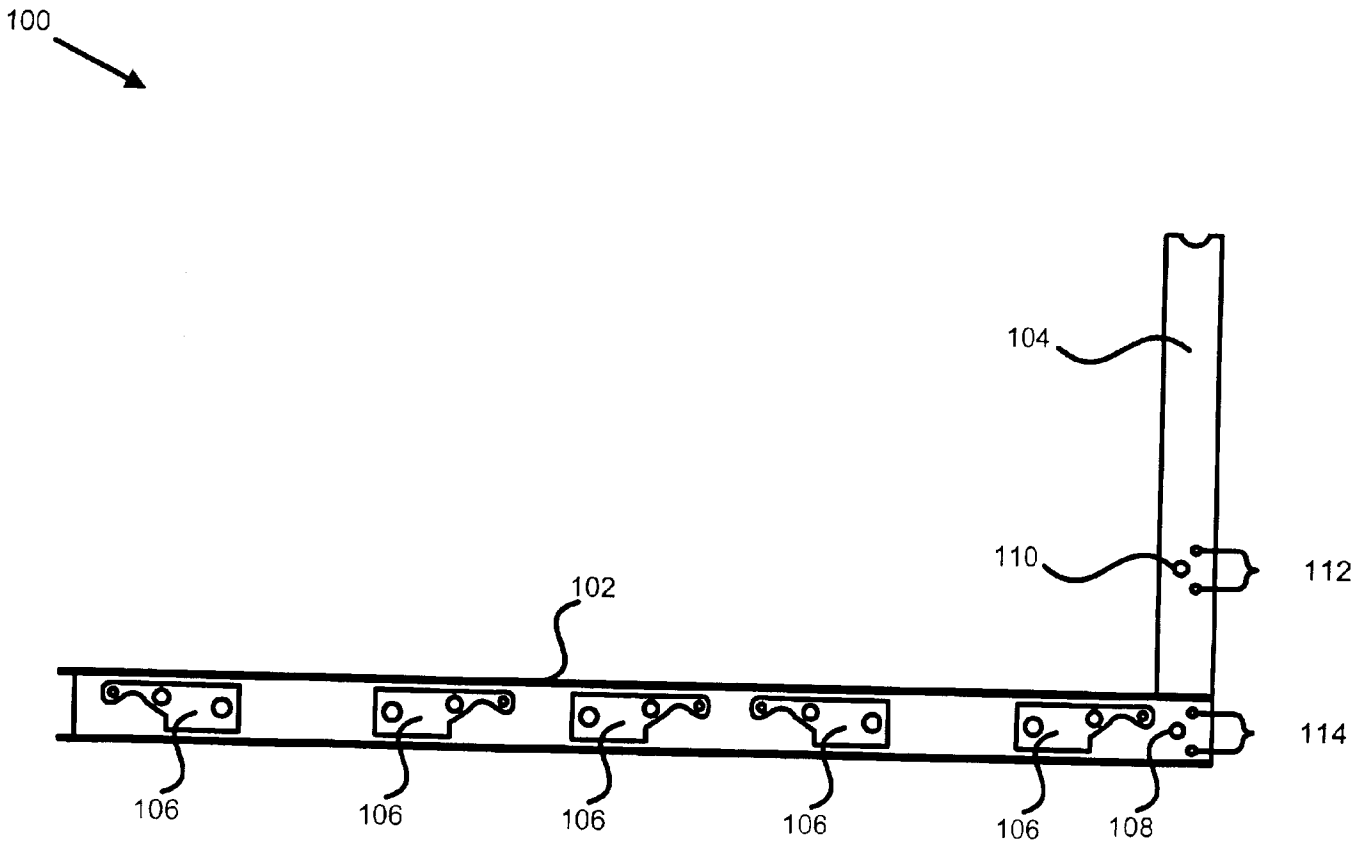
FIG. 1 is a top view illustrating one embodiment of a modular framing tool in accordance with the present invention.
Figure 2A:
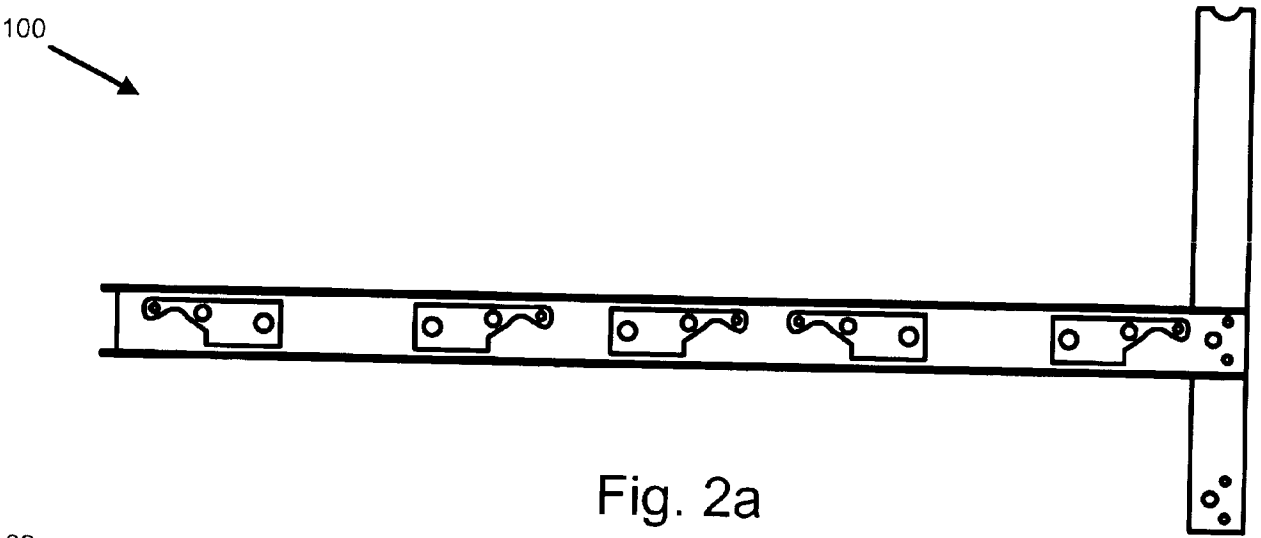
FIG. 2*a* is a top view illustrating a further embodiment of a modular framing tool in accordance with the present invention.

FIG. 1 shows a schematic block diagram illustrating one embodiment of a modular framing tool 100 of the present invention. In one embodiment, the modular framing tool 100 comprises a body portion 102 and a tool attachment that in the depicted embodiment comprises a squaring attachment 104. In the depicted embodiment, the body portion 102 and the squaring attachment 104 are connected to form a large framing square. The body portion 102 comprises a plurality of rotatably coupled alignment members 106. The function of the alignment members will be described in greater detail with respect to FIGS. 2*b*, 3*a*, and 3*b*. Referring now to the squaring attachment 104, shown therein is a plurality of holes 108 and 110. Also depicted are coupling posts 112 and 114. In one embodiment, the body portion 102 comprises a plurality of holes (not shown) configured to receive the coupling posts 114 or 112. These holes or any other suitable mechanism for receiving a suitable corresponding mechanism on the tool attachment form a connecting mechanism. In the depicted embodiment, the modular framing tool 100 is configured as a framing square by coupling the body portion 102 to the coupling posts 114. Alternatively, the body portion 102 may receive the coupling posts 112 to form a T-square, as depicted in the embodiment of FIG. 2*a*. A removable fastening device (not shown in FIG. 1) is configured to couple the body portion 102 and the squaring attachment 104 through hole 108 or hole 110. Of course, any suitable mechanism may be used to couple the tool attachment to the body portion 102.

Figure 2B:
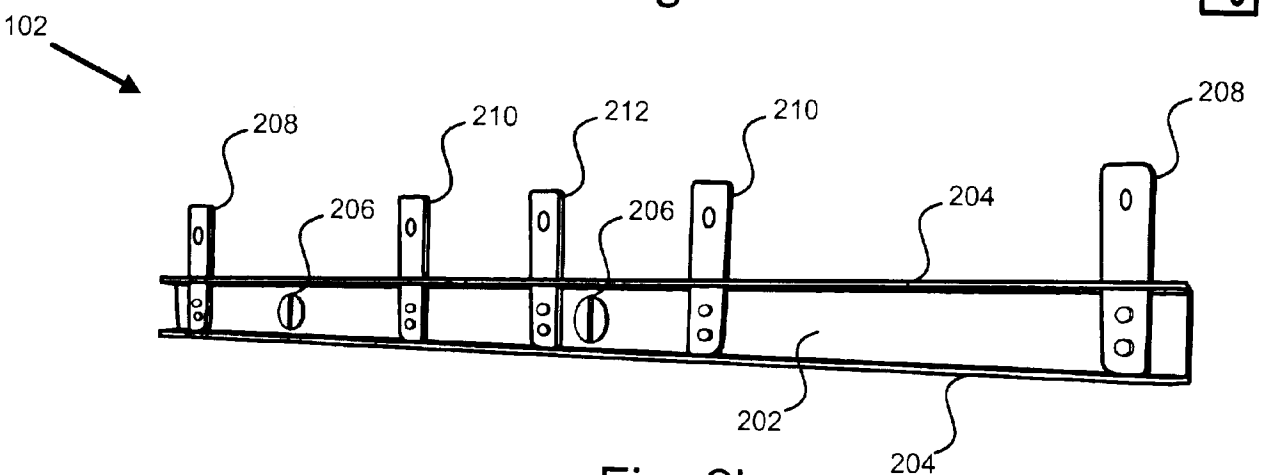
FIG. 2*b* is a perspective view illustrating one embodiment of a body portion of a modular framing tool in accordance with the present invention.

FIG. 2*b* is a perspective view of a further embodiment of the body portion 102. In the embodiment of FIG. 2*b*, the body portion 102 has a selected length, for example, of 49 inches and is formed as a U-beam. The U-beam body portion 102 is formed with a central portion 202, and side portions 204 extending upward approximately 1 inch from and at a right angle from either side of the central portion 202. The side portions 204 may comprise openings (shown at 313 in FIG. 3*b*) configured to allow the alignment members 208, 210, and 212 to extend therethrough from a retracted position to a substantially perpendicular extended position as shown. The alignment members of FIGS. 1 and 2*a* are in the retracted position.

The alignment members 208, 210, and 212 are substantially equivalent to the alignment members 106. In the depicted embodiment, the alignment members 208, 210, and 212 are configured with a width equivalent to that of common framing beams, approximately 1.5 inches in the most common case. Embedded within the central portion 202 is shown a plurality of leveling devices 206. The leveling devices 206 of the depicted embodiment may comprise standard bubble levels that are well known to those skilled in the art of home building.

The alignment members 208, 210, and 212 are positioned at intervals in order to facilitate framing of either 16 inch or 24 inch spaced beams. For example, in order to frame a 16 inch beam system, alignment members 208 and 210 are extended while leaving alignment member 212 retracted. Alternatively, framing a 24 inch beam system requires that alignment members 208 and 212 are extended. Once the appropriate alignment members 208, 210, 213 are extended, a builder may trace, with a suitable writing instrument, the alignment members 208 or 210 onto a base plate. Use of the alignment members eliminates the need to measure with flexible measuring tape while estimating the width of the beam to be attached. The rigid nature of the body portion 102, along with the fixed position of the alignment members 208, 210, and 212 facilitates accurate beam placement.

Figure 3A:
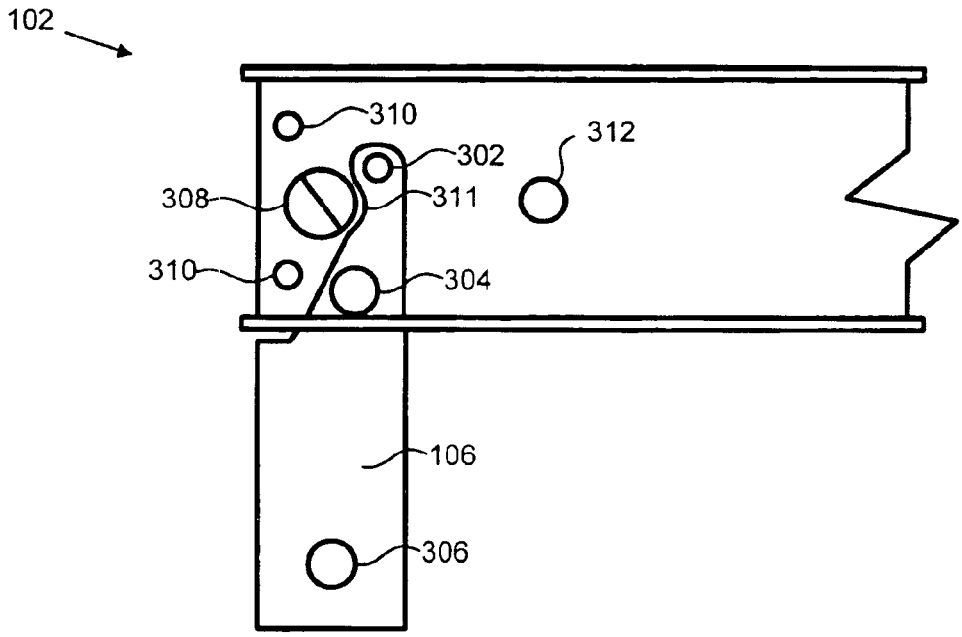
FIG. 3*a* is a top view illustrating one embodiment of an alignment member of a modular framing tool in accordance with the present invention.

Referring now to FIG. 3*a*, shown therein is a schematic block diagram illustrating one embodiment of the body portion 102 and the alignment member 106 of FIGS. 1 and 2*a*. In the illustrated embodiment, the alignment member 106 comprises a fastening mechanism 302, a locking mechanism 304, and a hole 306. In one embodiment, the fastening mechanism 302 may be a bolt system configured to allow the free rotation of the alignment member 106. The locking mechanism 304 may be a spring loaded plunger knob configured to lock automatically into place within catches or holes 305 when the alignment member 106 is fully extended and when the alignment member 106 is in a retracted position. In the depicted embodiment, the hole 306 is configured with a chamfered edge to facilitate extraction and retraction of the alignment member 106. Additionally, the hole 306 may be used for temporary attachment to a beam with the use of a nail or other fastening device.

In one embodiment, the body portion 102 also comprises a coupling mechanism 308, and a plurality of holes 310 for receiving the tool attachment. The coupling mechanism 308 is preferably a spring-loaded, hand operated bolt system configured to be received by the hole 110 of the squaring attachment 104 of FIG. 1. The holes 310 receive the coupling posts 112 of the squaring attachment 104, and are configured to create a substantially right angle between the body portion 102 and the squaring attachment 104. The alignment member 106 is configured with a cutout portion 311 so that the alignment member 106 may extend and be flush with the end of the body portion 102. The alignment member 106 ability to be flush with the end of the body portion 102 is necessary when outlining locations of beams that will be located in corners.

Figure 3B:
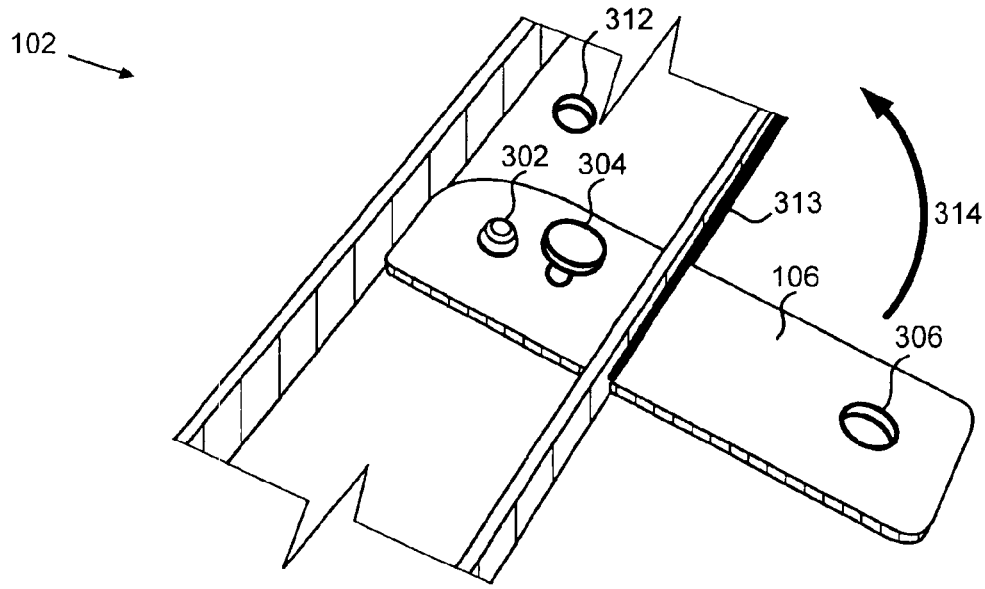
FIG. 3*b* is a perspective view illustrating one embodiment of an alignment member of a modular framing tool in accordance with the present invention.

FIG. 3*b* is a perspective side and top view of the body portion 102. In the depicted embodiment, the body portion 102 is configured with a plurality of holes 312 for receiving the spring-loaded locking mechanism 304. For example, while the alignment member 106 is extended, the locking mechanism 304 is engaged with the hole (not shown). However, upon retracting the alignment member 106, the locking mechanism 304 engages the hole 312. The arrow 314 indicates the sweeping motion of the alignment member 106 during rotation.

Figure 4A:
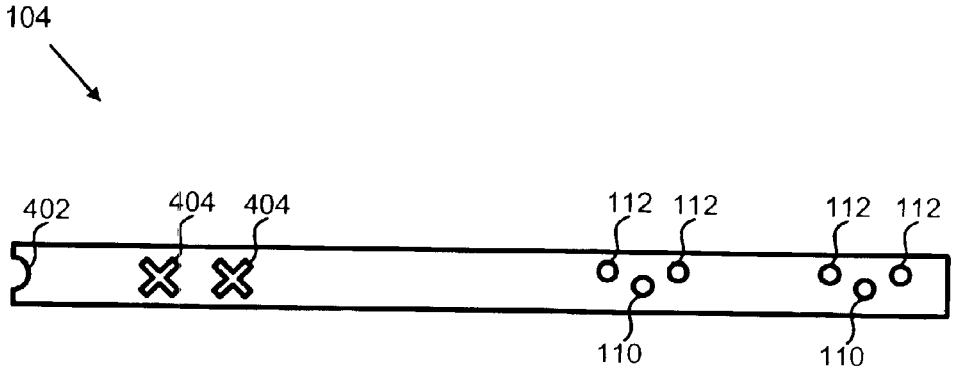
FIG. 4*a* is a block view illustrating one embodiment of a squaring attachment in accordance with the present invention.

Referring now to FIG. 4*a*, shown therein is a top view of the squaring attachment 104 comprising a cutout portion 402, and a plurality of holes 404 for locating centers of holes to be drilled in a board. In one embodiment, the holes 404 are configured as an X for ease of marking. The cutout portion 402 of the squaring attachment 104 is placed adjacent a protruding bolt, over which the board must be placed. Typically, the bolt will be an anchor bolt, which is generally located at the corners of the foundation of the structure being built and all around the perimeter of the foundation at approximately four foot intervals.

One of the other holes 404 may then be used to find the center of the board (e.g., a bottom plate of a wall) that is to be placed over that hole. Once the proper hole for the length of the board has been marked, a hole is drilled in the board at the location of the mark. The board may then be placed over the protruding bolt.

Figure 4B:
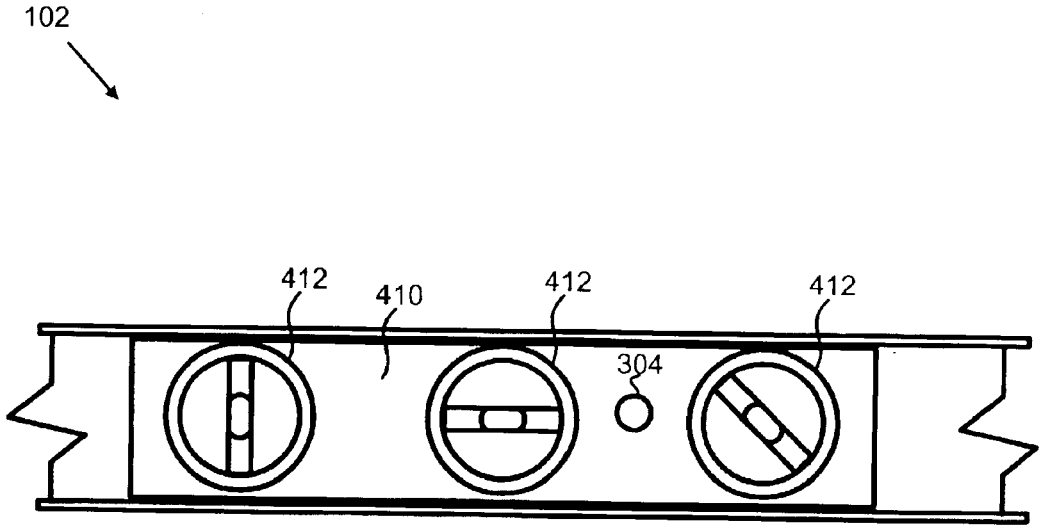
FIG. 4*b* is a top view illustrating one embodiment of a leveling apparatus of a modular framing tool in accordance with the present invention.

FIG. 4*b* is a top view of one embodiment of the body portion 410 of the present invention. In the embodiment of FIG. 4*b*, the body portion 102 is configured to receive a leveling apparatus 410. The leveling apparatus 410 comprises a plurality of leveling bubbles 412. The depicted leveling apparatus 410 is also configured with a hole to receive the locking mechanism 304 of the body portion. By adding the leveling apparatus 410, the body portion 102 becomes an oversized level.

Figure 5:
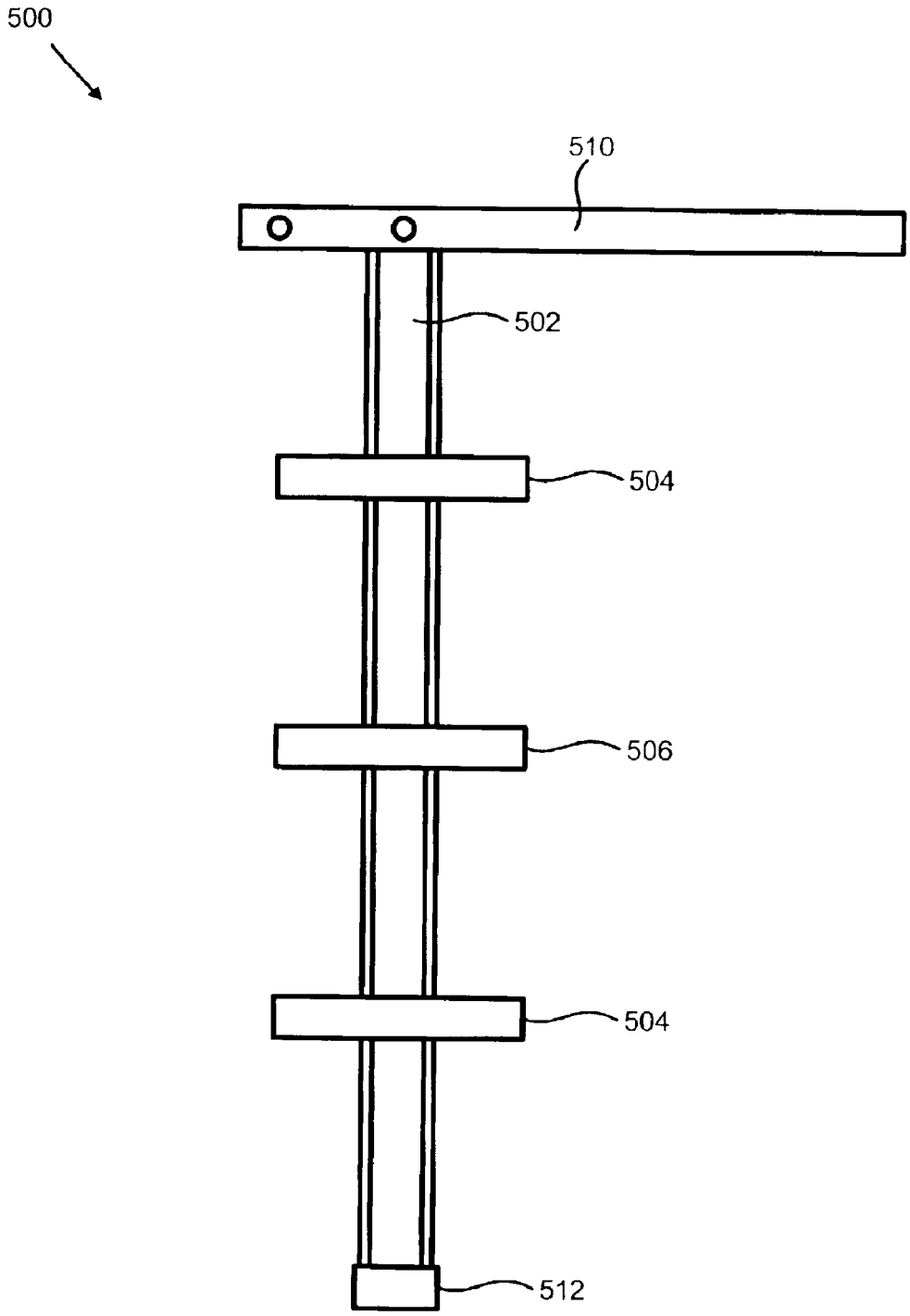
FIG. 5 is a top view illustrating a further embodiment of a modular framing tool in accordance with the present invention.

FIG. 5 shows a top view illustrating an alternative embodiment of the modular framing tool 500 of the present invention. The modular framing tool comprises a body portion 502, side layout attachments 504, a center layout attachment 506, a squaring attachment 510, and an end clip 512. The depicted modular framing tool 500 shows the body portion 502 with all tools 504, 506, and 512 attached by way of example. The discussion of FIGS. 6*a*, 6*b*, 6*c*, 7*a*, and 7*b* will describe in greater detail the individual components of the modular framing tool 500.

Figure 6A:
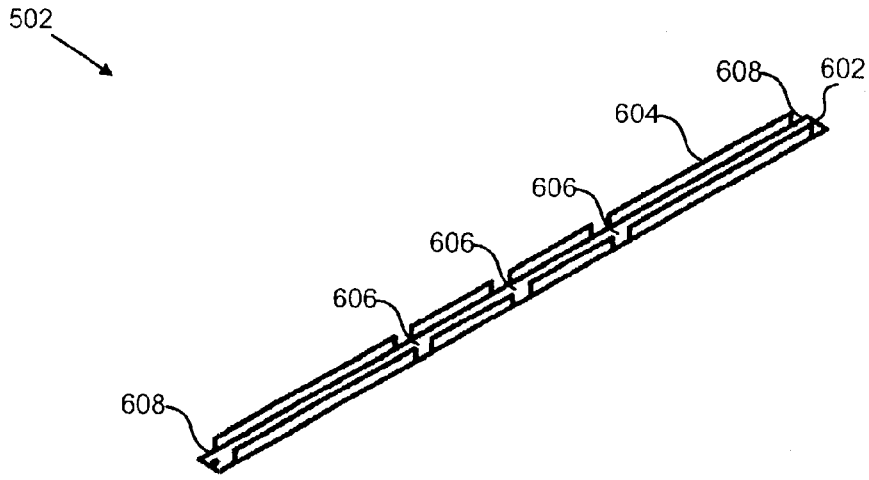
FIG. 6*a* is a perspective view illustrating a further embodiment of a body portion of a modular framing tool in accordance with the present invention.
Figure 6B:
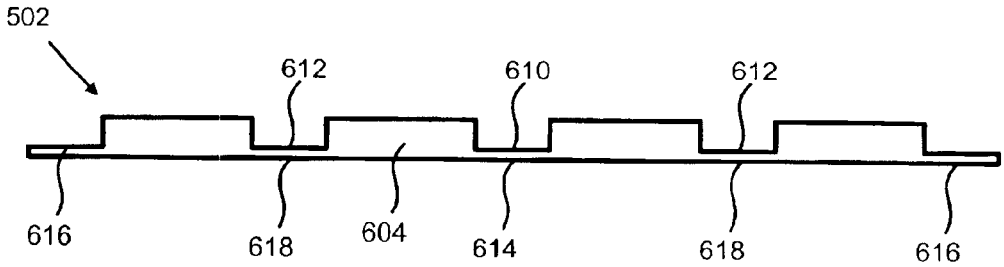
FIG. 6*b* is side view illustrating a further embodiment of a squaring attachment of a modular framing tool in accordance with the present invention.

FIG. 6*a* shows a perspective view of a body portion 502 of the modular framing tool 500 of the present invention. The body portion 502 in the depicted embodiment is preferably 49½ inches long and is formed as a U-Beam. The body portion 502 may be formed in any suitable manner, including machining, extrusion, and injection. In the depicted embodiment, the body portion 502 is formed with a central portion 602 and a wall 604 extending upward at a right angle from either side of the central portion 602.

The body portion 502 as depicted has a plurality of channels 606 and partial channels 608 formed therein. At the center of each channel 606 or partial channel 608 is preferably formed a hole (not shown). The holes are used to connect layout attachments 504 of the modular framing tool 500 to the body portion 502.

The channels 606 are in one embodiment formed by openings 610 (shown in FIG. 6*b*) in the channel walls 604. Preferably, parallel openings 610 are formed in each of the walls 604. The openings are formed with a selected width of, in the depicted embodiment, 1.5 inches. The partial channels 608 are formed similar to the channels 606, but rather than being formed from full openings 610, are formed with gaps 612 which have a wall 604 on only one side thereof.

Forming the channels 606 and partial channels 608 with spacing as shown allows the modular framing tool to be used to measure both 16" and 24" centers. That is, a central channel 614 is disposed centrally between the partial channels 616, and the side channels 618 are provided with centers 16 inches apart and 16 inches from the center of the nearest partial channel 616.

Figure 6C:
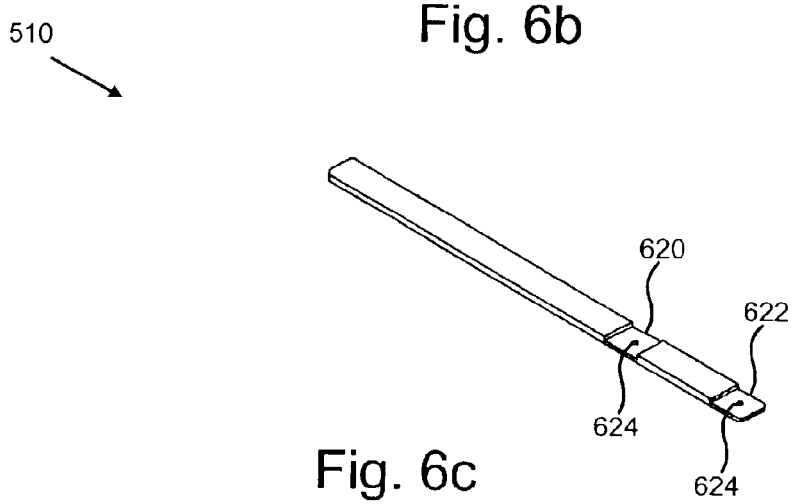
FIG. 6*c* is a perspective view of one embodiment of a squaring attachment in accordance with the present invention.

FIG. 6*c* shows a perspective view of one embodiment of a squaring attachment 510. The squaring attachment 510 is preferably formed of rolled steel, is substantially rectangular, and has a length of 24 inches. Other materials may also be used, including aluminum and plastic. Provided within the squaring attachment 510 are a plurality of slots 620, 622 formed therein, each having a hole 624 formed in the center thereof. Each of the slots 620, 622 is sized to be received into a channel 606 or partial channel 608 of the body portion 502. The slots 620, 622 align the squaring attachment 510 at right angles to the body portion 502, forming a carpenter's square if the slot 722 is used, and a T-square when the slot 720 is used.

Figure 7A:
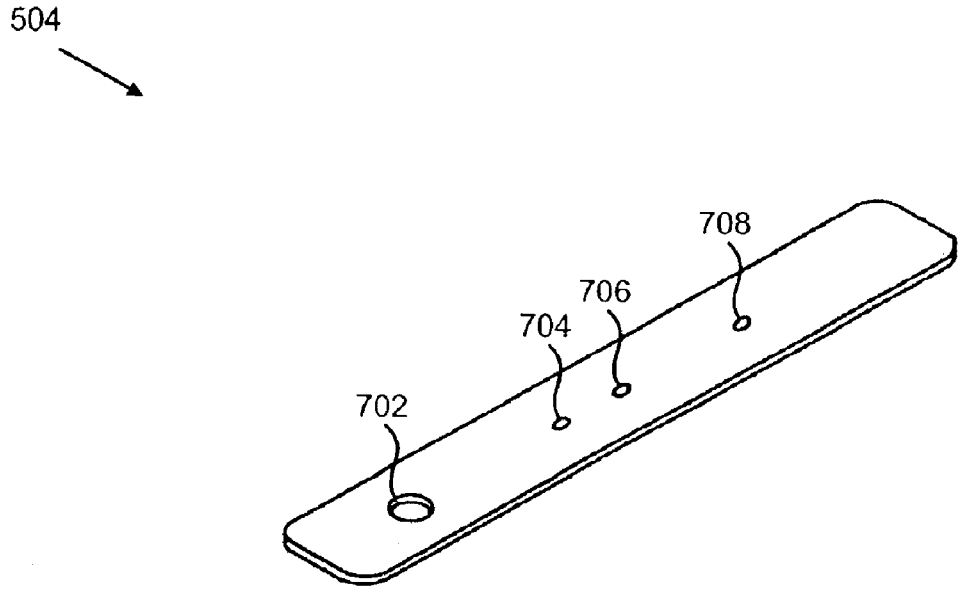
FIG. 7*a* is a perspective view illustrating a further embodiment of an alignment member of a modular framing tool in accordance with the present invention.

FIG. 7*a* shows a perspective view of one embodiment of a layout attachment 504. The layout attachment 504 is preferably formed of rolled steel, is substantially rectangular, and has a length of approximately 10 inches. Provided within the layout attachment 504 are a plurality of holes 702, 704, 706, and 708. The holes 704, 706, and 708 are preferably formed with a 0.188" diameter. The hole 702 is preferably formed with a 0.563 diameter and is centered 1.5 inches from the proximal end of the layout attachment 504. The holes 704, 706, and 708 are located 4 inches, 5 inches, and 7 inches from the proximal end, respectively.

A plurality of the layout attachments 504 may be attached to the channels 606 and 608 of the body portion 502 of FIG. 6*a*. With the layout attachments 504 in place, the proper positioning for placing trusses on wall studs may be easily and reliably marked. The modular framing tool configured as described above may be placed on top of a wall and pencil marks may be used down both sides of the layout attachments 42 to indicate the position for trusses to be placed at the top of the wall. A similar procedure may be used for locating wall studs.

Subsequently, trusses may be attached in the proper place to the wall by first attaching two trusses in the proper location, and then using the body portion 502 of FIG. 5 with the clips 512 of FIG. 5 attached to both ends. The 16 inch or 24 inch center arrangement is used as described. Once the third truss is secured in place, the body portion 502 is then moved to the second and third truss, and a fourth truss is placed in the now empty slot on the end. This process is continued until all the trusses are located in place. The procedure for 16" centers is substantially similar to that for 24" centers, except that the depicted embodiment of the modular framing tool will accommodate four trusses at a time, rather than just three.

The layout attachment 504 of FIG. 7*a*, in addition to being usable as a cross member attached to the body portion 502 of FIG. 5, is also configured to be used to locate centers of holes for receiving anchor bolts. In so doing, the large hole 702 of the layout attachment 504 is placed over a protruding bolt, over which a board must be placed. Typically, the bolt will be an anchor bolt, which is generally located at the corners of the foundation of the structure being built and all around the perimeter of the foundation at approximately four-foot intervals.

One of the other holes may then be used then to find the center of the board (e.g., a bottom plate of a wall) that is to be placed over that hole. In so doing, the proper hole 704, 708 is selected according to the width of the board. Once the proper hole for the length of the board has been marked, a hole is drilled in the board at the location of the mark. The board may then be placed over the protruding bolt. This is generally done when the wall has been framed with studs between a bottom plate (the board having a series of holes measured in this manner) and a top plate.

Figure 7B:
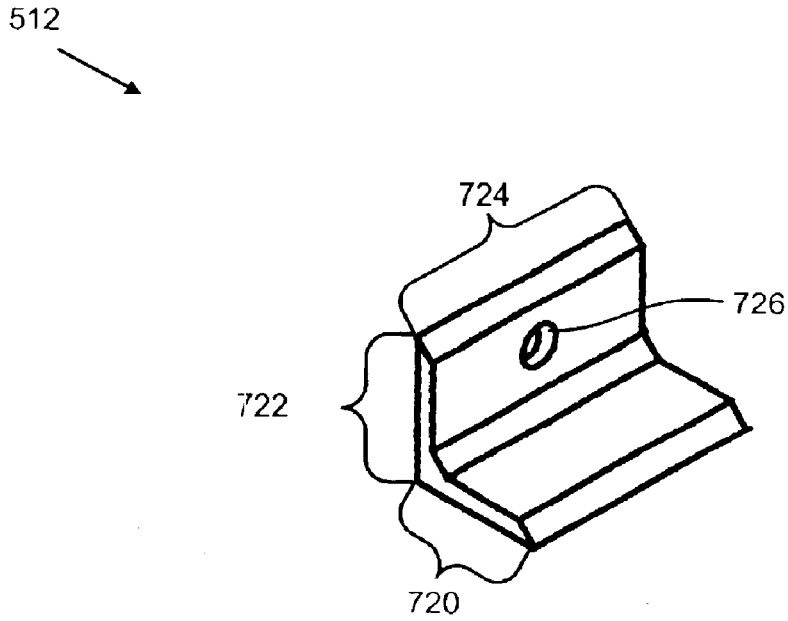
FIG. 7*b* is perspective view illustrating one embodiment of a clip of a modular framing tool in accordance with the present invention.

FIG. 7*b* shows a perspective view of the clip 512. The clip 512, in one embodiment, is used to transform the partial channels 608 of FIG. 6*a* into full channels 606. The clip 512 is preferably formed of rolled steel, and has two sides 720, 722 extending outward from each other at right angles. In one embodiment, the preferred dimensions of the sides 720, and 722 are one inch. Additionally, the width 724 of the clip 512 is preferably 1.75 inches. A hole 726 is formed in the center of one side 722 with a preferred diameter of 0.281 inches.

The clip 512 of FIG. 7*b* is adapted to be attached to one end of the body portion 500 as shown in FIG. 5. A bolt (not shown) is fastened through the hole 726 attaching the clip 512 to the body portion 502 as shown in FIG. 5. In one embodiment, two clips 512 may be used, one fastened to each end of the body portion 502. The body portion 502 with the attached clips 512 is then used to space beams that are used in walls or ceilings and/or to mark the positions of beams that need to be spaced with a distance between them of 24 or 16 inches. If 24 inch spacing is used, the outside channels 616 and the center channel 614 are used, accommodating therein three equally spaced boards with 24" centers. If 16 inch centers are to be used, the outside channels 616 and the side channels 618 are then used to accommodate four boards with sixteen inch centers.

Figure 8:
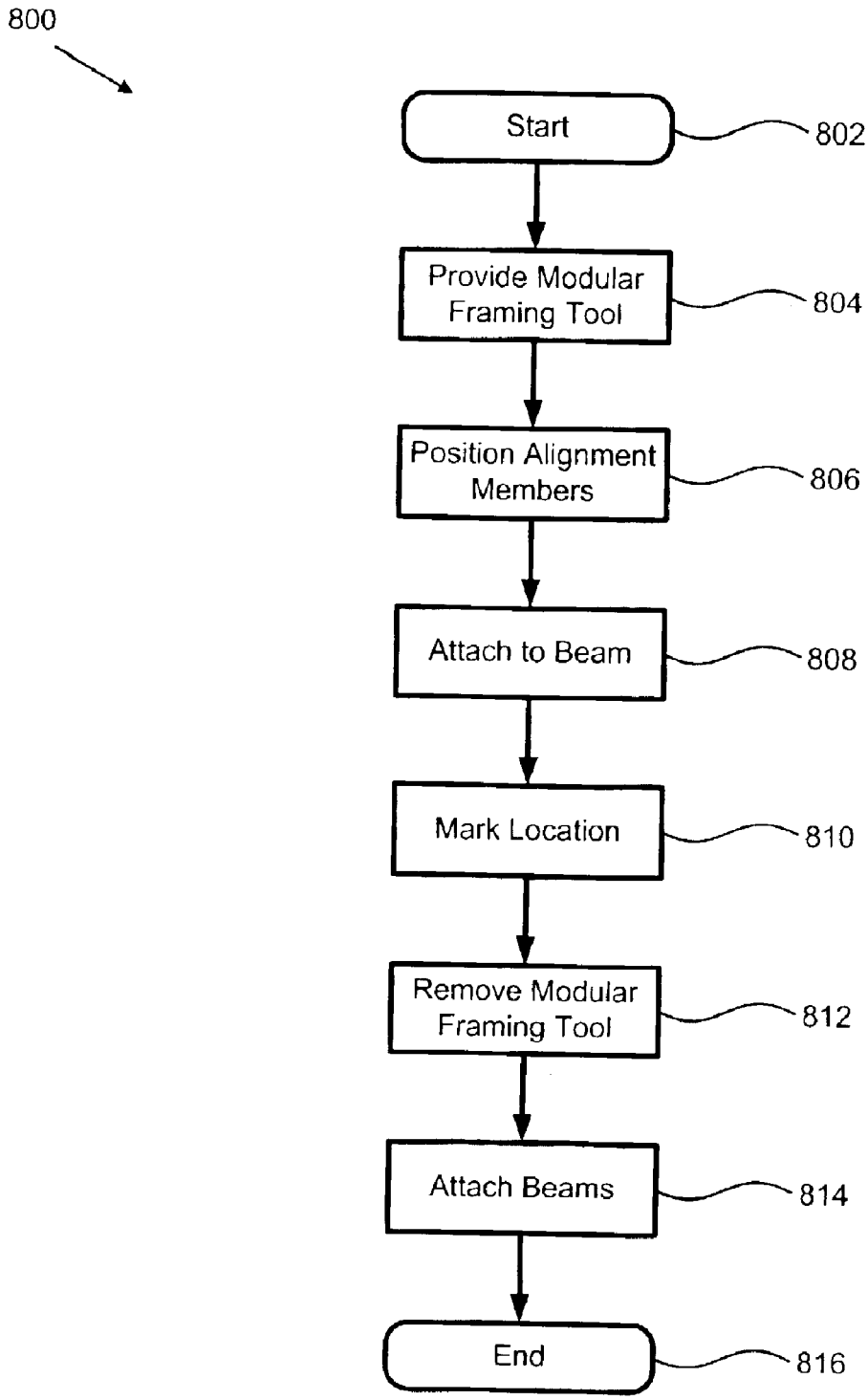
FIG. 8 is a schematic flow chart diagram depicting one method for using the modular framing tool in accordance with the present invention.

Referring now to FIG. 8, shown therein is a schematic flow chart diagram illustrating one method 800 of using the modular framing tool 100 of the present invention. The method 800 starts 802 and the modular framing tool is provided 804. The alignment members are then positioned 806. In one embodiment positioning 806 the alignment members 106 comprises rotating the alignment members to an extended position as in FIG. 3*b*. Alternatively, positioning 806 the alignment members 106 comprises attaching the layout attachments 504. The method 800 continues and the modular framing tool 100 is attached 808 to a beam, and then the locations are marked 810. After removing 812 the modular framing tool 100, beams may be attached 814 at the marked locations.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular framing tool, comprising:

an elongated body portion, the body portion provided with an attachment mechanism for receiving a tool attachment; and a plurality of alignment members pivotally connected to the body portion at regular intervals, the intervals between centers of the alignment members selected to be one of 16 and 24 inches.

2. The modular framing tool of claim 1, wherein the plurality of alignment members are removable and configured to be selectively attached in a manner useful for positioning beams.

3. The modular framing tool of claim 1, wherein the plurality of alignment members are permanently attached and are transitionable between a retracted position and an extended position, the extended position useful for positioning beams.

4. The modular framing tool of claim 3, wherein the plurality of alignment members are rotatably attached and are configured to be selectively positioned to protrude from the body portion at a substantially perpendicular angle in the extended position, and to be at least substantially retracted into the body portion in the retracted position.

5. The modular framing tool of claim 3, wherein the alignment members further comprise a hole disposed therein for temporary attachment to a beam.

6. The modular framing tool of claim 3, wherein at least one of the alignment members comprises a spring loaded locking apparatus configured to maintain the alignment member in the extended position.

7. The modular framing tool of claim 1, wherein the plurality of alignment members are attached to the body portion at regular intervals.

8. The modular framing tool of claim 1, further comprising a clip attachment adapted to connect to a partial channel of the body portion to form an additional regularly spaced channel therein.

9. The modular framing tool of claim 1, wherein the tool attachment comprises a squaring attachment having a cut-out portion disposed at a first end of the squaring attachment, the cut-out portion configured to receive therein an anchor bolt for transferring centers.

10. The modular framing tool of claim 9, wherein the squaring attachment comprises a plurality of holes disposed proximal to the cut-out portion, the holes adapted for transferring centers.

11. The modular framing tool of claim 1, wherein the tool attachment comprises a plurality of holes selectively positioned to form a T-square when the tool attachment is connected to the body portion.

12. The modular framing tool of claim 1, wherein the tool attachment comprises a plurality of holes selectively positioned to form a framing square when the tool attachment is connected to the body portion.

13. The modular framing tool of claim 1, further comprising a leveling apparatus for accurate leveling of the beam, the body portion configured to receive the leveling apparatus therein.

14. A method for positioning beams using a modular framing tool, the method comprising:

providing a modular framing tool having a plurality of pivotally connected alignment members;

placing a plurality of pivotally connected alignment members in a selected position with respect to the modular framing tool, the selected position sufficient for use in positioning beams;

indicating a position on a first beam using the alignment members;

securing a second beam parallel to the first beam at the indicated position; and receiving a tool attachment.

15. The method of claim 14, wherein placing a plurality of alignment members in a selected position comprises temporarily attaching the alignment members to a body portion of the modular framing tool at regular intervals.

16. The method of claim 14, wherein placing a plurality of alignment members in a selected position comprises rotating attached alignment members to a protracted and substantially perpendicular position.

17. The method of claim 16, wherein placing a plurality of alignment members in a selected position further comprises locking the alignment members in the protracted and substantially perpendicular position.

18. The method of claim 14, wherein the second beam is part of a truss system, and further comprising positioning and aligning a plurality of trusses of the truss system using the modular framing tool.

19. The method of claim 14, wherein the second beam comprises a stud, and further comprising positioning and aligning a plurality of studs in a selected sequential order using the modular framing tool.

20. A modular framing tool, comprising:

an elongated body portion configured with at least one straight edge;

a plurality of alignment members pivotally connected to the body portion at regular intervals, the intervals between centers of the alignment members selected to be one of 16 and 24 inches; and a squaring attachment comprising a member having a plurality of holes therein, at least one of the holes adapted to connect to the body portion.

* * * * *